US009197971B2

(12) United States Patent
Michael et al.

(10) Patent No.: US 9,197,971 B2
(45) **Date of Patent: *Nov. 24, 2015**

(54) PERSONALIZED HEARING PROFILE GENERATION WITH REAL-TIME FEEDBACK

(71) Applicant: CVF, LLC, Chicago, IL (US)

(72) Inventors: Nicholas R Michael, San Francisco, CA (US); Ephram Cohen, San Francisco, CA (US); Meena Ramani, Cupertino, CA (US); Caslav V Pavlovic, Palo Alto, CA (US)

(73) Assignee: CVF, LLC, Chicago, IL (US)

( * ) Notice: Subject to any disclaimer, the term of this patent is extended or adjusted under 35 U.S.C. 154(b) by 352 days.

This patent is subject to a terminal disclaimer.

(21) Appl. No.: 13/756,260

(22) Filed: Jan. 31, 2013

(65) Prior Publication Data

US 2013/0142366 A1 Jun. 6, 2013

Related U.S. Application Data

(63) Continuation of application No. 12/778,930, filed on May 12, 2010, now Pat. No. 8,379,871.

(51) Int. Cl.
*H04R 29/00* (2006.01)
*H04R 25/00* (2006.01)
(Continued)

(52) U.S. Cl.
CPC ..... *H04R 25/50* (2013.01); *H04R 5/04* (2013.01); *H04R 5/033* (2013.01); *H04R 25/70* (2013.01); *H04R 2205/041* (2013.01)

(58) Field of Classification Search
CPC ..... H04R 29/00; H04R 25/00; H04R 25/70; H04R 25/30; H03G 5/00
USPC ..... 381/60, 103, 312, 314
See application file for complete search history.

(56) References Cited

U.S. PATENT DOCUMENTS 4,061,874 A 12/1977 Fricke et al.
6,011,853 A 1/2000 Koski et al.
(Continued)

FOREIGN PATENT DOCUMENTS

DE 10222408 A1 11/2003
EP 0705016 A2 4/1996
(Continued)

OTHER PUBLICATIONS

International Search Report mailed Aug. 17, 2011 in PCT/US2011/036135.
(Continued)

*Primary Examiner* — Disler Paul
(74) *Attorney, Agent, or Firm* — Haynes Beffel & Wolfeld LLP; James F. Hann

(57) ABSTRACT

A personalized hearing profile is generated for an ear-level device comprising a memory, microphone, speaker and processor. Communication is established between the ear-level device and a companion device, having a user interface. A frame of reference in the user interface is provided, where positions in the frame of reference are associated with sound profile data. A position on the frame of reference is determined in response to user interaction with the user interface, and certain sound profile data associated with the position. Certain data is transmitted to the ear level device. Sound can be generated through the speaker based upon the audio stream data to provide real-time feedback to the user. The determining and transmitting steps are repeated until detection of an end event.

25 Claims, 17 Drawing Sheets

(51) Int. Cl.
*H04R 5/04* (2006.01)
*H04R 5/033* (2006.01)

(56) References Cited

U.S. PATENT DOCUMENTS

| | | | | |
|---|---|---|---|---|
| 6,058,197 | A | 5/2000 | Delage | |
| 6,212,496 | B1 | 4/2001 | Campbell et al. | |
| 6,463,128 | B1 | 10/2002 | Elwin | |
| 6,532,005 | B1 | 3/2003 | Campbell | |
| 6,684,063 | B2 | 1/2004 | Berger et al. | |
| 6,813,490 | B1 | 11/2004 | Lang et al. | |
| 6,840,908 | B2 | 1/2005 | Edwards et al. | |
| 6,850,775 | B1 | 2/2005 | Berg | |
| 6,944,474 | B2 * | 9/2005 | Rader et al. | 455/550.1 |
| 7,181,297 | B1 | 2/2007 | Pluvinage et al. | |
| 7,190,795 | B2 | 3/2007 | Simon | |
| 7,328,151 | B2 | 2/2008 | Muesch | |
| 8,107,636 | B2 * | 1/2012 | McLeod | 381/60 |
| 8,379,871 | B2 | 2/2013 | Michael et al. | |
| 8,577,049 | B2 * | 11/2013 | Soelberg et al. | 381/60 |
| 2003/0078515 | A1 | 4/2003 | Menzel et al. | |
| 2004/0008849 | A1 | 1/2004 | Moller | |
| 2004/0136555 | A1 | 7/2004 | Enzmann | |
| 2005/0248717 | A1 | 11/2005 | Howell et al. | |
| 2006/0045281 | A1 | 3/2006 | Korneluk et al. | |
| 2007/0255435 | A1 | 11/2007 | Cohen et al. | |
| 2008/0025538 | A1 | 1/2008 | Zad-Issa | |
| 2008/0137873 | A1 | 6/2008 | Goldstein | |
| 2008/0165980 | A1 | 7/2008 | Pavlovic et al. | |
| 2009/0074214 | A1 * | 3/2009 | Bradford et al. | 381/312 |
| 2009/0154741 | A1 | 6/2009 | Woods et al. | |
| 2009/0180631 | A1 | 7/2009 | Michael et al. | |
| 2009/0290725 | A1 | 11/2009 | Huang | |
| 2010/0027824 | A1 | 2/2010 | Atamaniuk et al. | |
| 2010/0029337 | A1 | 2/2010 | Kuhl et al. | |
| 2010/0119093 | A1 * | 5/2010 | Uzuanis et al. | 381/312 |
| 2011/0176686 | A1 | 7/2011 | Zaccaria | |

FOREIGN PATENT DOCUMENTS

| | | | |
|---|---|---|---|
| EP | 1089526 | A2 | 4/2001 |
| EP | 2073511 | A1 | 6/2009 |
| JP | H07203600 | A | 8/1995 |
| JP | 2000209698 | A | 7/2000 |
| JP | 2001136593 | A | 5/2001 |
| WO | 0124576 | A1 | 4/2001 |
| WO | 0154458 | A2 | 7/2001 |
| WO | 03026349 | A1 | 3/2003 |
| WO | 2004110099 | A2 | 12/2004 |
| WO | 2006105105 | A2 | 10/2006 |

OTHER PUBLICATIONS

Lippmann, R. P. et al., Study of multichannel amplitude compression and linear amplification for persons with sensorineural hearing loss, J. Acoust. Soc. Am. 69(2), Feb. 1981, pp. 524-534.

European Search Report dated Oct. 23, 2013 from EP 11781235.4, 8 pages.

* cited by examiner

Output Gain / Dynamic Range Compression Options

| Frequency Shaping Patterns | 1 | 2 | 3 | 4 |
|---|---|---|---|---|
| 1 | 992 | | | |
| 2 | | 994 | | |
| 3 | | | | |
| 4 | | | | |
| 5 | | | | 993 |
| 6 | | | | |

*FIG. 10*

PERSONALIZED HEARING PROFILE GENERATION WITH REAL-TIME FEEDBACK

RELATED APPLICATIONS

This application is a continuation of co-pending U.S. patent application Ser. No. 12/778,930 filed on 12 May 2010, which application is incorporated by reference as if fully set forth herein.

BACKGROUND OF THE INVENTION

The present invention relates to personalized sound systems, including an ear-level device adapted to be worn on the ear, and the use of such systems to select hearing profiles to be applied using the sound system.

Ear-level devices, including headphones, earphones, head sets, hearing aids and the like, are adapted to be worn at the ear of a user and provide personal sound processing. U.S. patent application Ser. No. 11/569,449, entitled Personal Sound System Including Multi-Mode Ear-level Module with Priority Logic, published as U.S. Patent Application Publication No. US-2007-0255435-A1 is incorporated by reference as if fully set forth herein. In US-2007-0255435-A1, a multi-mode ear-level device is described in which configuration of the ear-level device and call processing functions for a companion mobile phone are described in detail.

It is widely understood that hearing levels vary widely among individuals, and it is also known that signal processing techniques can condition audio content to fit an individual's hearing response. Individual hearing ability varies across a number of variables, including thresholds of hearing, or hearing sensitivity (differences in hearing based on the pitch, or frequency, of the sound), dynamic response (differences in hearing based on the loudness of the sound, or relative loudness of closely paired sounds), and psychoacoustical factors such as the nature of and context of the sound. Actual injury or impairment, physical or mental, can also affect hearing in a number of ways. A widely used gauge of hearing ability is a profile showing relative hearing sensitivity as a function of frequency.

The most widespread employment of individual hearing profiles is in the hearing aid field, where some degree of hearing impairment makes intervention a necessity. This entails detailed testing in an audiologist or otologist office, employing sophisticated equipment and highly trained technicians. The result is an individually-tailored hearing aid, utilizing multiband compression to deliver audio content exactly matched to the user's hearing response. However, this process is typically expensive, time-consuming and cumbersome, and it plainly is not suitable for mass personalization efforts.

The rise of the Internet has offered the possibility for the development of personalization techniques that flow from on-line testing. Efforts in that direction have sought to generate user hearing profiles by presenting the user with a questionnaire, often running to 20 questions or more, and using the user input to build a hearing profile. Such tests have encountered problems in two areas, however. First, user input to such questionnaires has proved unreliable. Asked about their age alone, without asking for personal information, for example, users tend to be less than completely truthful. To the extent such tests can be psychologically constructed to filter out such bias, the test becomes complex and cumbersome, so that users simply do not finish the test.

Another testing regime is set out in U.S. Pat. No. 6,840,908, entitled System and Method for Remotely Administered, Interactive Hearing Tests, issued to Edwards and others on 11 Jan. 2005, and owned by the assignee of the present application. That patent presents a number of techniques for such testing, most particularly a technique called N-Alternative Forced Choice, in which a user is offered a number of audio choices among which to select one that sounds best to her. Also known as sound flavors, based on the notion of presenting sound and asking the user which one is preferred; this method can lack sufficient detail to enable the analyst to build a profile.

Although different forms of test procedures for generating a personalized hearing profile have been employed by the art, none has been deployed in a way to produce accurate results for a large number of consumers.

SUMMARY OF THE INVENTION

A personalized hearing profile is generated for an ear-level device comprising a memory, a microphone and a speaker, each coupled to a processor. Communication is established between the ear-level device and a companion device having a user interface. A frame of reference in the user interface is provided, where positions in the frame of reference are associated with sound profile data. A position on the frame of reference is determined in response to user interaction with the user interface, and certain sound profile data associated with the position. A chosen one of the following is transmitted to the ear level device: (a) certain sound profile data, whereby the ear level device is capable of generating sound through the speaker based upon the certain sound profile data to provide real-time feedback to the user, or (b) audio stream data generated using (1) an audio stream generated by the companion device, and (2) the certain sound profile data. The ear level device is thereby capable of generating sound through the speaker based upon the audio stream data to provide real-time feedback to the user. The determining and transmitting steps are repeated until detection of an end event.

In some examples the communication establishing step is carried out with a chosen one of a mobile phone, digital music player or computer as the companion device. In some examples the certain sound profile data is transmitted to the ear level device; and an audio stream is provided for the ear level device, which the ear level device can play on the speaker during execution of the sound profile program. In some examples the rendering step is carried out with the sound profile data comprising frequency band amplitude adjustment data and dynamic range adjustment data. In some examples the sound profile data includes a plurality of preset profiles associated with respective positions on the frame of reference, each preset profile comprising dynamic range compression data and frequency shaping data.

In some examples the user interface includes a graphical user interface executed using a display associated with the user interface, and a visual indicator is displayed on the display resulting from the user interaction with the graphical user interface, the visual indicator corresponding to a position on the frame of reference for the sound profile data. In some examples, with the exception of the visual indicator, the display is maintained free of visual indicia correlating location on the frame of reference to the sound profile data.

Other aspects and advantages of the present invention can be seen on review of the drawings, the detailed description, and the claims which follow.

BRIEF DESCRIPTION OF THE DRAWINGS

FIG. 10 illustrates a frame of reference, rendered in the graphical user interface, showing 24 different combinations of frequency shaping patterns and output gain/dynamic range compression options.

DETAILED DESCRIPTION

Figure 1:
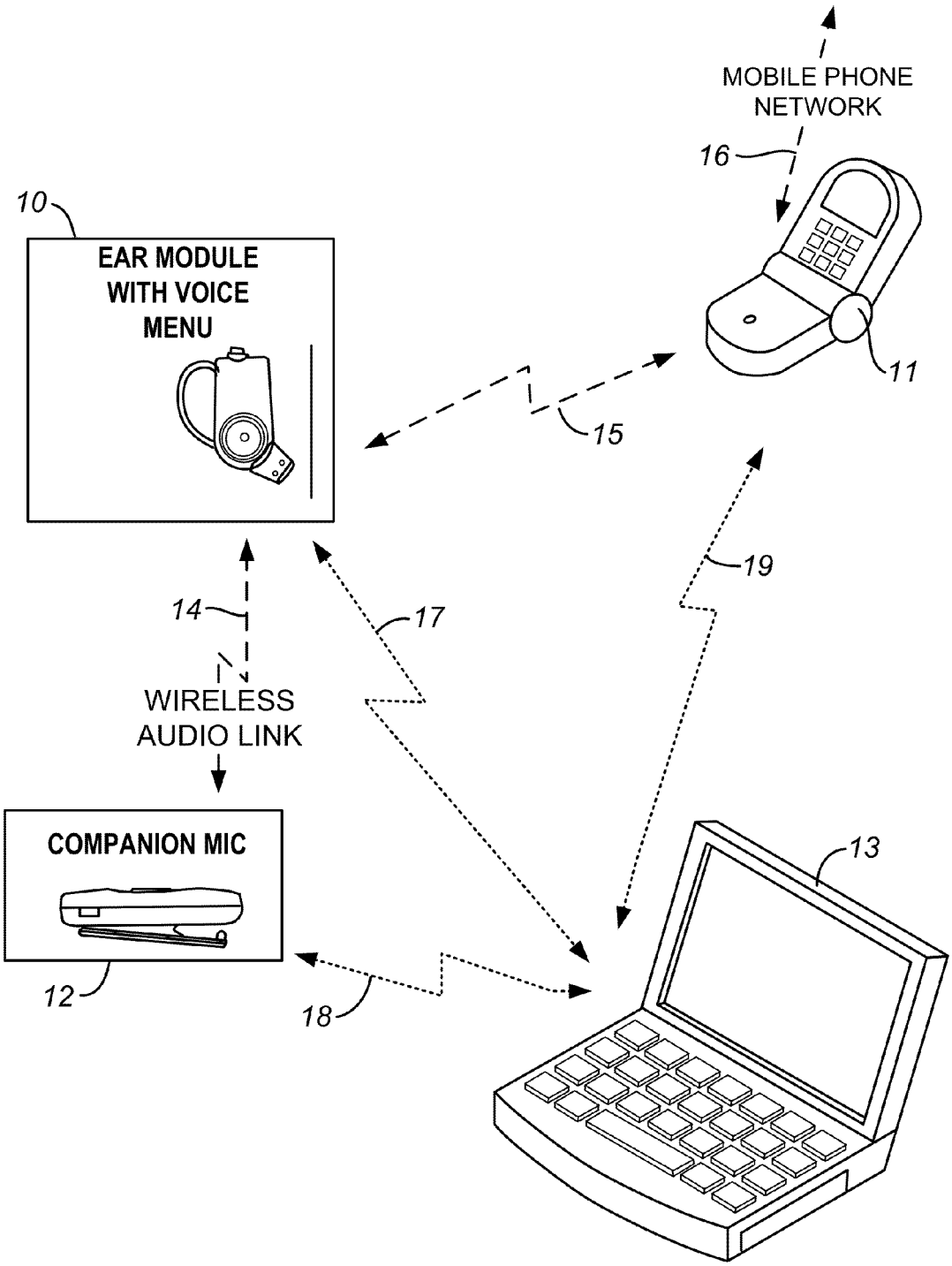
FIG. 1 is a simplified diagram of a wireless network including an ear-level device supporting a voice menu as described herein, along with companion modules which can communicate with the ear-level device.

FIG. 1 illustrates a wireless network including an ear module 10, adapted to be worn at ear-level, and a mobile phone 11. Also, included in the illustrated network are a companion computer 13, and a companion microphone 12. The ear module 10 can include an environmental mode for listening to sounds in the ambient environment. The network facilitates techniques for providing personalized sound at the ear module 10 from a plurality of companion audio sources such as mobile phones 11, computers 13, and microphones 12, as well as other companion devices such as televisions and radios.

The ear module 10 is adapted to operate in a plurality of modes, corresponding to modes of operating the ear module, such as a Bluetooth® mode earpiece for the phone 11, and the environmental mode. The ear module and the companion devices can execute a number of functions in support of utilization of the ear module in the network.

The ear module 10 includes a voice menu mode in which data indicating a function to be carried out by the ear module or by a companion device, such as a mobile phone 11, is selected in response to user input on the ear module 10. The user input can be for example the pressing of a button on the ear module 10.

In one embodiment described herein, the wireless audio links 14, 15 between the ear module 10 and the linked companion microphone 12, between the ear module 10 and the companion mobile phone 11 respectively, are implemented according to Bluetooth® compliant synchronous connection-oriented SCO channel protocol (See, for example, Specification of the Bluetooth System, Version 4.0, 17 Dec. 2009). Wireless link 16 couples the mobile phone 11 to a network service provider for the mobile phone service. The wireless configuration links 17, 18, 19 between the companion computer 13 and the ear module 10, the mobile phone 11, and the linked companion microphone 12, and optionally the other audio sources are implemented using a control channel, such as a modified version of the Bluetooth® compliant serial port profile SPP protocol or a combination of the control channel and SCO channels. (See, for example, BLUETOOTH SPECIFICATION, SERIAL PORT PROFILE, Version 1.1, Part K:5, 22 Feb. 2001).

Of course, a wide variety of other wireless communication technologies may be applied in alternative embodiments. The mobile phone 11, or other computing platform such as computer 13, preferably has a graphical user interface and includes for example a display and a program that displays a user interface on the display such that the user can select functions of the mobile phone 11 such as call setup and other telephone tasks, which can then be selectively carried out via user input on the ear module 10, as described in more detail below. Alternatively, the user can select the functions of the mobile phone 11 via a keyboard or touch pad suitable for the entry of such information. The mobile phone 11 provides mobile phone functions including call setup, call answering and other basic telephone call management tasks in communication with a service provider on a wireless telephone network or other network. In addition, and as discussed below, mobile phone 11, or other computing platform such as computer 13, can be used to allow the user to generate a personalized hearing profile for ear module 10.

The companion microphone 12 consists of small components, such as a battery operated module designed to be worn on a lapel, that house "thin" data processing platforms, and therefore do not have the rich user interface needed to support configuration of private network communications to pair with the ear module 10. For example, thin platforms in this context do not include a keyboard or touch pad practically suitable for the entry of personal identification numbers or other authentication factors, network addresses, and so on. Thus, to establish a private connection pairing with the ear module, the radio is utilized in place of the user interface.

Figure 2:
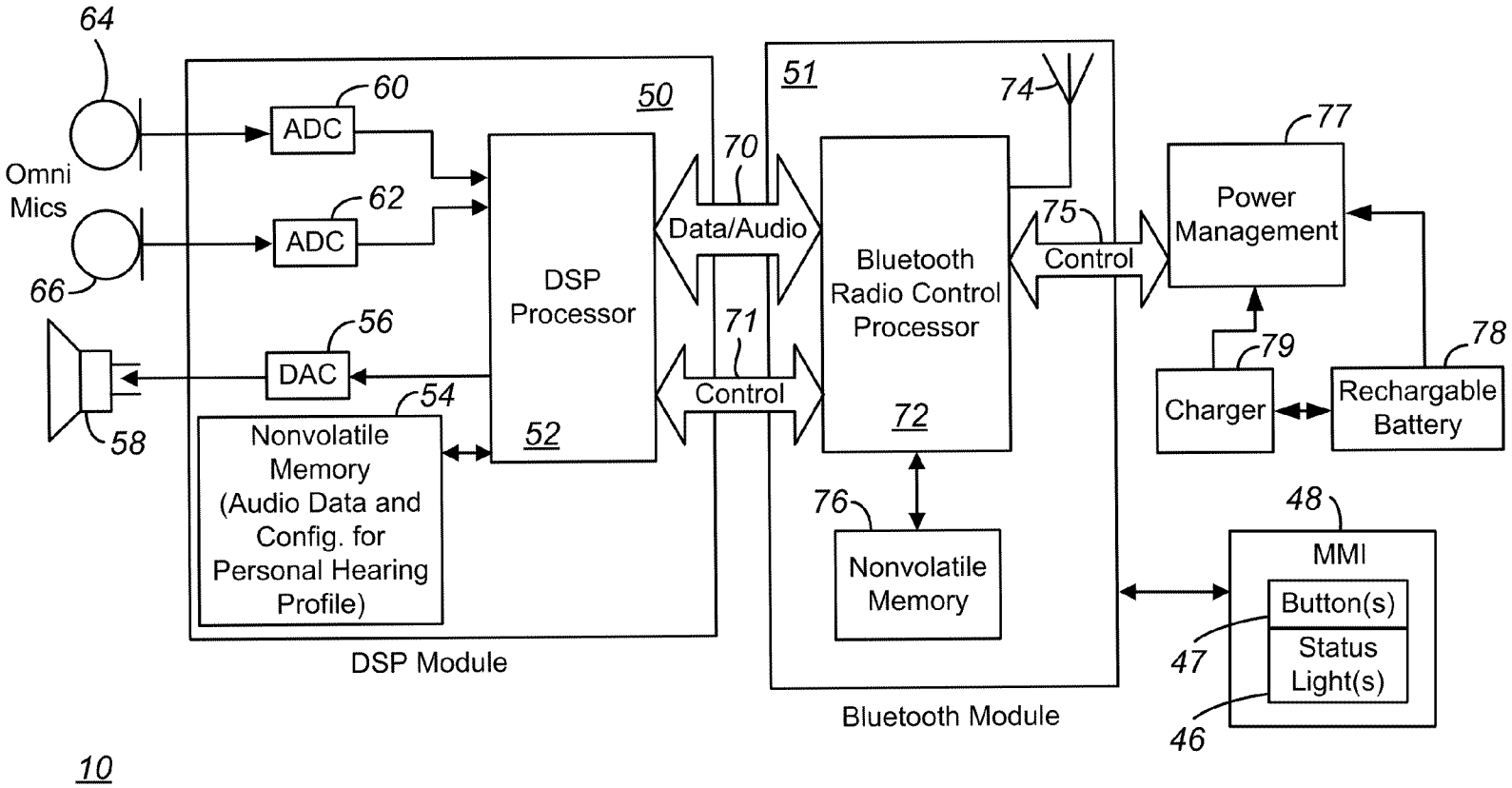
FIG. 2 is a simplified block diagram of circuitry in an ear-level device supporting generating a personalized hearing profile as described herein.

FIG. 2 is a system diagram for microelectronic and audio transducer components of a representative embodiment of the ear module 10. The system includes a data processing module 50 and a radio module 51. The data processing module includes a digital signal processor 52 (hence the reference to "DSP" in some of the Figs.) coupled to nonvolatile memory 54. A digital-to-analog converter 56 converts digital output from the digital signal processor 52 into analog signals for supply to speaker 58 at the tip of the interior lobe of the ear module 10. A first analog-to-digital converter 60 and a second analog-to-digital converter 62 are coupled to two omnidirectional microphones 64 and 66 on the exterior lobe of the ear module. The analog-to-digital converters 60, 62 supply digital inputs to the digital signal processor 52.

The nonvolatile memory 54 stores audio data associated with various functions that can be carried out by the companion mobile phone. The nonvolatile memory 54 also stores computer programs and configuration data for controlling the ear module 10. These include providing a control program, a configuration file and audio data for the personalized hearing profiles, also called sound profiles. The programs are executed by the digital signal processor 52 in response to user input on the ear module 10. In addition, the nonvolatile memory 54 stores a data structure for a set of variables used by the computer programs for audio processing, where each mode of operation of the ear module may have one or more separate subsets of the set of variables, referred to as "presets" herein. In addition, memory 54 can store one or more individually generated sound profiles, as discussed below; further, one or more test sounds can be stored in memory 54 for use in creating the individually generated sound profiles.

The radio module 51 is coupled to the digital signal processor 52 by a data/audio bus 70 and a control bus 71. The radio module 51 includes, in this example, a Bluetooth® radio/baseband/control processor 72. The processor 72 is coupled to an antenna 74 and to nonvolatile memory 76. The nonvolatile memory 76 stores computer programs for operating the radio module 51 and control parameters as known in the art. The nonvolatile memory 76 is adapted to store parameters for establishing radio communication links with companion devices. The processing module 50 also controls the man-machine interface 48 for the ear module 10, including accepting input data from the one or more buttons 47 and providing output data to the one or more status lights 46.

In the illustrated embodiment, the data/audio bus 70 transfers pulse code modulated audio signals between the radio module 51 and the processing module 50. The control bus 71 in the illustrated embodiment comprises a serial bus for connecting universal asynchronous receive/transmit UART ports on the radio module 51 and on a processing module 50 for passing control signals.

A power control bus 75 couples the radio module 51 and the processing module 50 to power management circuitry 77. The power management circuitry 77 provides power to the microelectronic components on the ear module in both the processing module 50 and the radio module 51 using a rechargeable battery 78. A battery charger 79 is coupled to the battery 78 and the power management circuitry 77 for recharging the rechargeable battery 78.

The microelectronics and transducers shown in FIG. 2 are adapted to fit within the ear module 10.

The ear module 10 operates in a plurality of modes, including in the illustrated example, an environmental mode for listening to conversation or ambient audio, a phone mode supporting a telephone call, a companion microphone mode for playing audio picked up by the companion microphone which may be worn for example on the lapel of a friend, and a hearing profile generation mode for generating a personalized hearing profile based upon real-time feedback to the user. The hearing profile generation mode will be described below with reference to a companion mobile phone device; however, the hearing profile generation mode could be carried out with other appropriate companion devices having a graphical user interface or other user interface having a touch sensitive area for producing user input based on at least two dimensions of touch position on the interface. The signal flow in the device changes depending on which mode is currently in use. An environmental mode does not involve a wireless audio connection. The audio signals originate on the ear module 10. The phone mode, the companion microphone mode, and the hearing profile generation mode involve audio data transfer using the radio module 51. In the phone mode, audio data is both sent and received through a communication channel between the radio and the phone. In the companion microphone mode, the ear module receives a unidirectional audio data stream from the companion microphone. In the hearing profile generation mode, the ear module 10 receives a profile data stream and may receive an audio stream from the companion mobile phone 11.

The control circuitry in the device is adapted to change modes in response to commands exchanged by the radio, and in response to user input, according to priority logic. For example, the system can change from the environmental mode to the phone mode and back to the environmental mode, the system can change from the environmental mode to the companion microphone mode and back to the environmental mode. For example, if the system is operating in environmental mode, a command from the radio which initiates the companion microphone may be received by the system, signaling a change to the companion microphone mode. In this case, the system loads audio processing variables (including preset parameters and configuration indicators) that are associated with the companion microphone mode. Then, the pulse code modulated data from the radio is received in the processor and up-sampled for use by the audio processing system and delivery of audio to the user. At this point, the system is operating in a companion microphone mode. To change out of the companion microphone mode, the system may receive an environmental mode command via the serial interface from the radio. In this case, the processor loads audio processing variables associated with the environmental mode. At this point, the system is again operating in the environmental mode.

If the system is operating in the environmental mode and receives a phone mode command from the control bus via the radio, it loads audio processing variables associated with the phone mode. Then, the processor starts processing the pulse code modulated data for delivery to the audio processing algorithms selected for the phone mode and providing audio to the microphone. The processor also starts processing microphone data for delivery to the radio and transmission to the phone. At this point, the system is operating in the phone mode. When the system receives a environmental mode command, it then loads the environmental audio processing variables and returns to environmental mode.

The control circuitry also includes logic to change to the Function Selection and Control Mode in response to user input via the man-machine interface 48.

Figure 3:
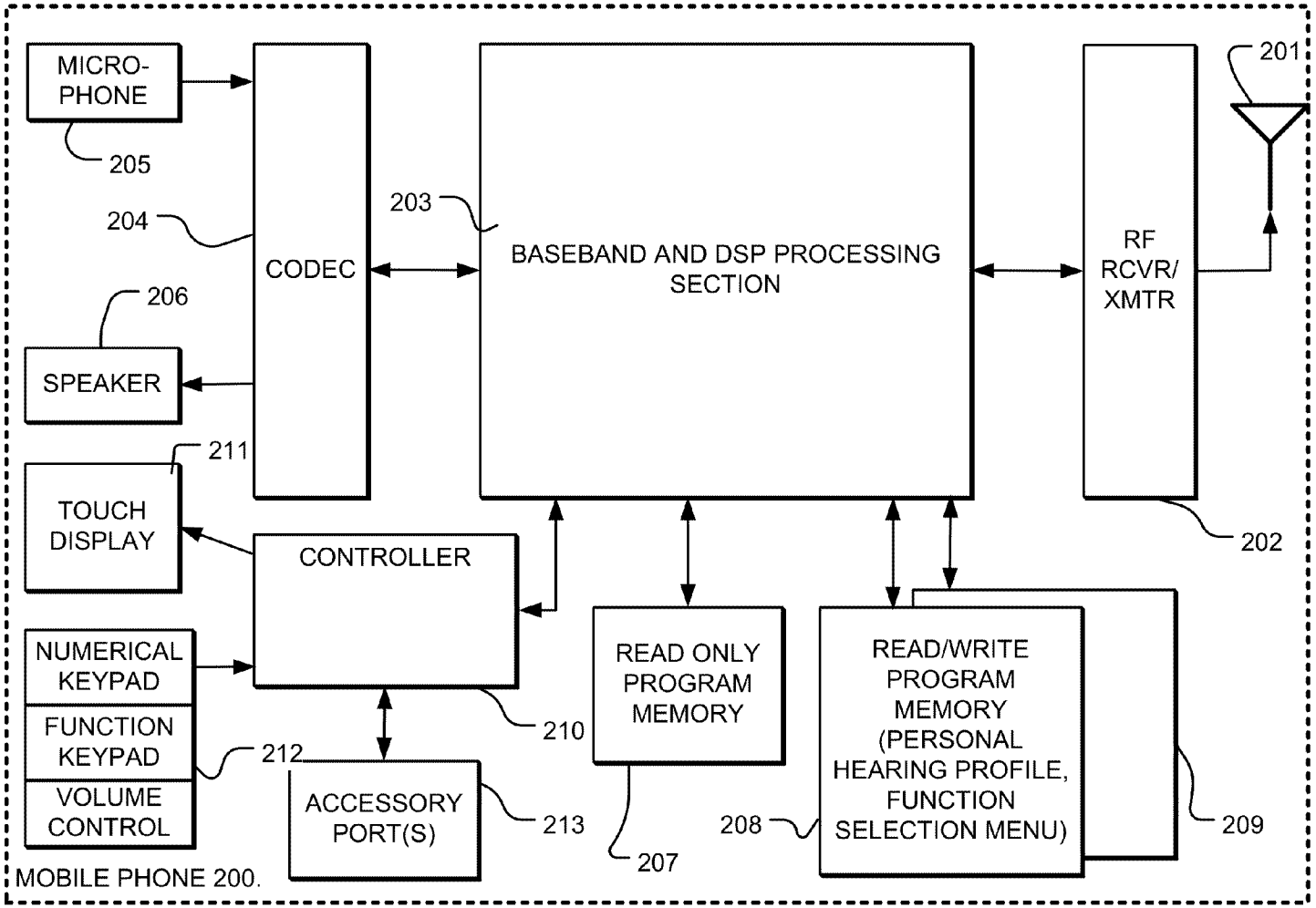
FIG. 3 is a simplified block diagram of circuitry in a mobile phone, operable as a companion module for an ear-level device and supporting generating a personalized hearing profile as described herein.

FIG. 3 is a simplified diagram of a mobile phone 200, representative of personal communication devices which provide resources for the user to select personal hearing profiles, discussed below. The mobile phone 200 includes an antenna 201 and a radio including a radio frequency RF receiver/transmitter 202, by which the phone 200 is coupled to a wireless communication medium, according to one or more of a variety of protocols. In examples described herein, the RF receiver/transmitter 202 can include one or more radios to support multiprotocol/multiband communications for communication with the wireless service provider of the mobile phone network, as well as the establishment of wireless local radio links using a protocol like Bluetooth® or WIFI protocols. The receiver/transmitter 202 is coupled to baseband and digital signal processor DSP processing section 203, in which the audio signals are processed and call signals are managed. A codec 204, including analog-to-digital and digital-to-analog converters, is coupled to the processing section 203. A microphone 205 and a speaker 206 are coupled to the codec 204.

Read-only program memory 207 stores instructions, parameters and other data for execution by the processing section 203. In addition, a read/write memory 208 in the mobile phone stores instructions, parameters, personal hearing profiles and other data for use by the processing section 203. There may be multiple types of read/write memory on the phone 200, such as nonvolatile read/write memory 208 (flash memory or EEPROM for example) and volatile read/write memory 209 (DRAM or SRAM for example), as shown in FIG. 3. Other embodiments include removable memory modules in which instructions, parameters and other data for use by the processing section 203 are stored.

An input/output controller 210 is coupled to a touch sensitive display 211, to user input devices 212, such as a numerical keypad, a function keypad, and a volume control switch, and to an accessory port (or ports) 213. The accessory port or ports 213 are used for other types of input/output devices, such as binaural and monaural headphones, connections to processing devices such as PDAs, or personal computers, alternative communication channels such as an infrared port or Universal Serial Bus USB port, a portable storage device port, and other things. The controller 210 is coupled to the processing section 203. User input concerning call set up and call management, and concerning use of the personal hearing profile, user preference and environmental noise factors is received via the input devices 212 and optionally via accessories. User interaction is enhanced, and the user is prompted to interact, using the display 211 and optionally other accessories. Input may also be received via the microphone 205 supported by voice recognition programs, and user interaction and prompting may utilize the speaker 206 for various purposes.

In the illustrated embodiment, memory 208 stores a program for displaying a function selection menu user interface on the display 211, such that the user can select the functions to be carried out during the generation of personal hearing profiles discussed below.

Figure 4:
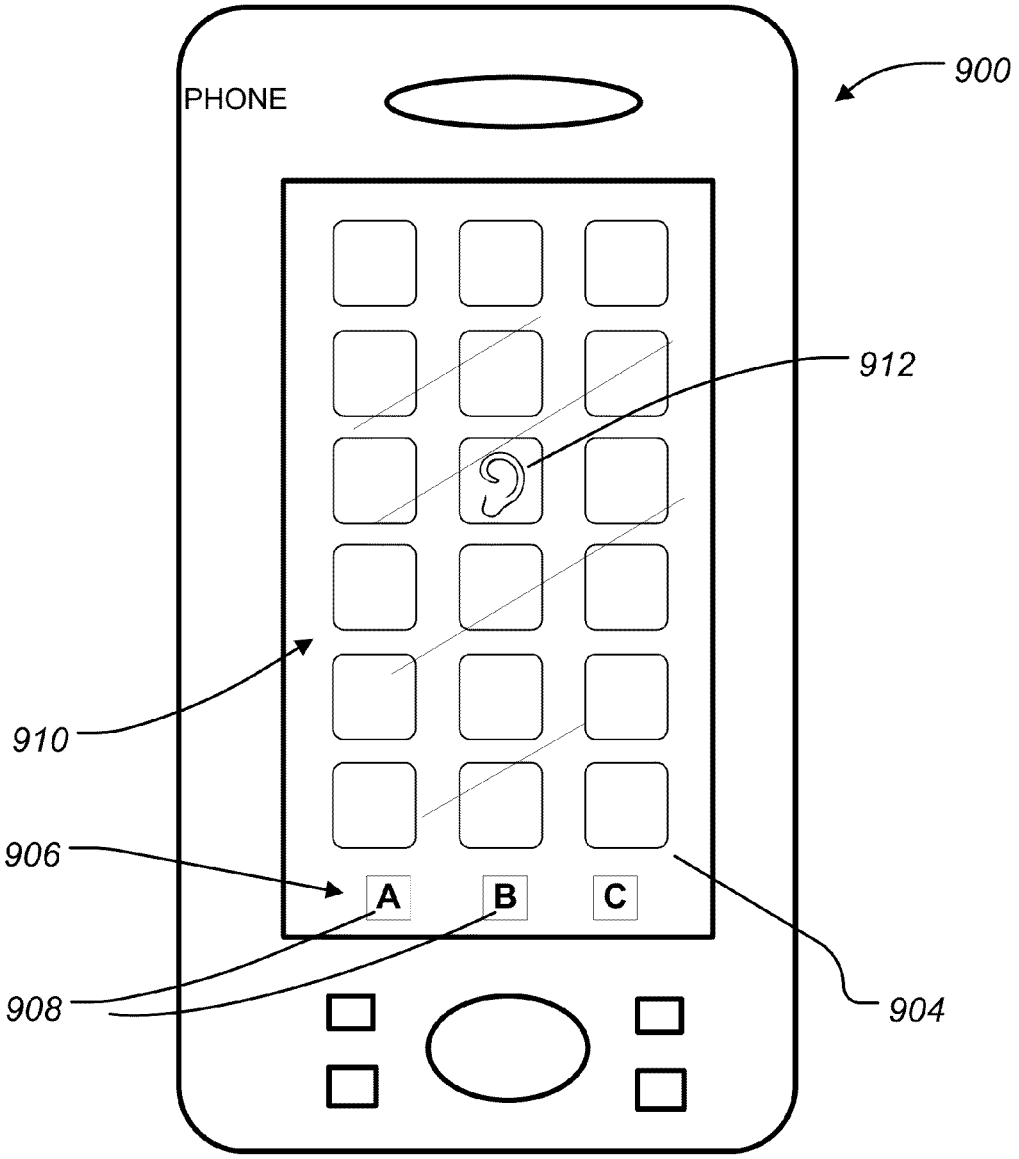
FIG. 4 is a front view of a mobile phone having a touch screen displaying application icons, including a hearing profile icon.

The generation of a personalized hearing profile for ear module 10 will be discussed primarily with reference to FIGS. 1 and 4-12. The communication link 15 between ear module 10 and mobile phone 11, or other companion device including a graphical user interface, will typically be a dual audio and communication link for the personalized hearing profile generation. FIG. 4 illustrates mobile phone 900 having a graphical user interface including a touch screen type of graphic display 904, sometimes referred to as touch screen 904. An example of mobile phone 900 is the iPhone® made by Apple Computer. Touch screen 904 includes a task bar 906 having system icons 908. Application icons 910 are also displayed on touch screen 904 and include a hearing profile icon 912.

Figure 5:
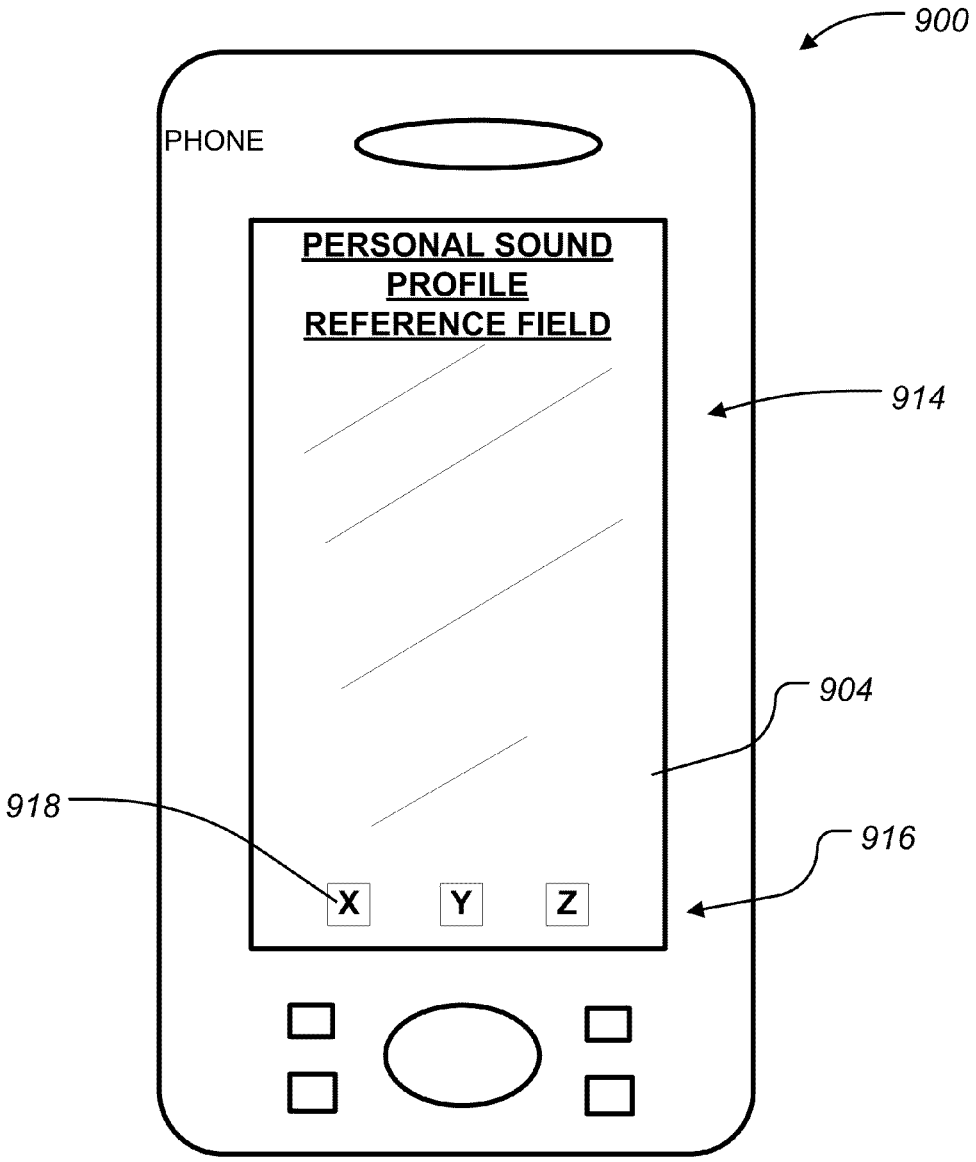
FIG. 5 shows the screen image displayed on the touch screen of the mobile phone of FIG. 4 after selecting the hearing profile icon.
Figure 6:
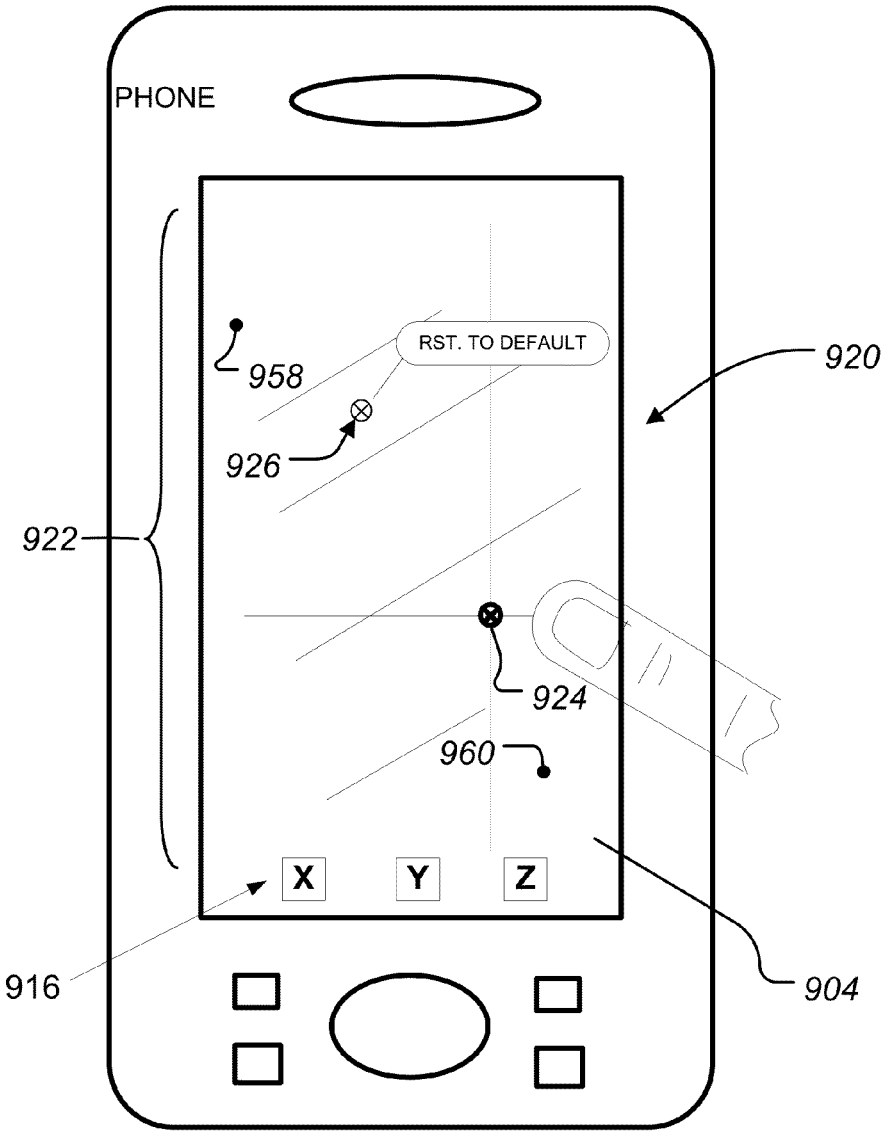
FIG. 6 shows a personal sound screen image which is displayed after selecting the personal icon on the task bar of FIG. 5.
Figure 7A:
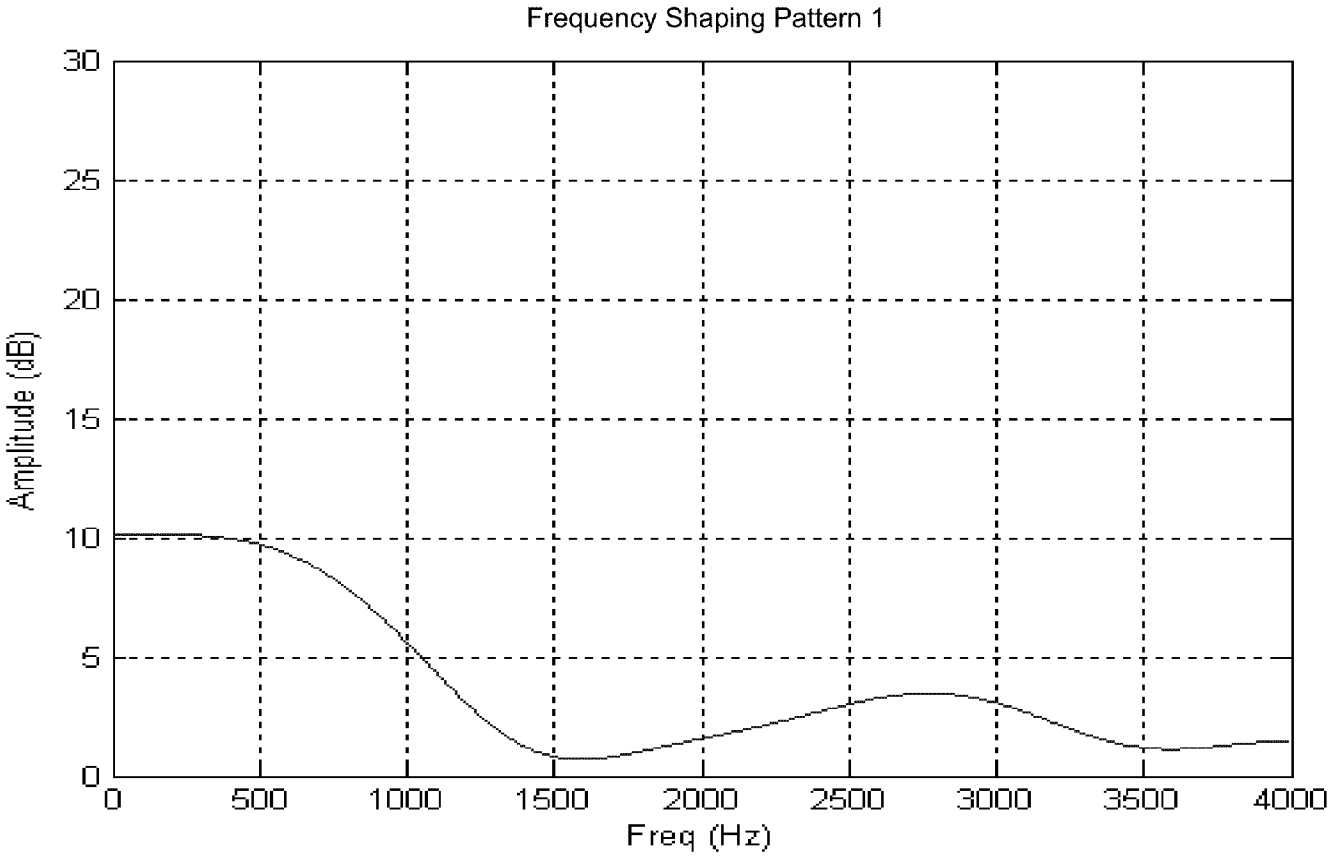
FIGS. 7A-7F illustrate the amplitude versus frequency response for six different filters used for the six frequency shaping patterns in the example of FIG. 10.
Figure 7B:
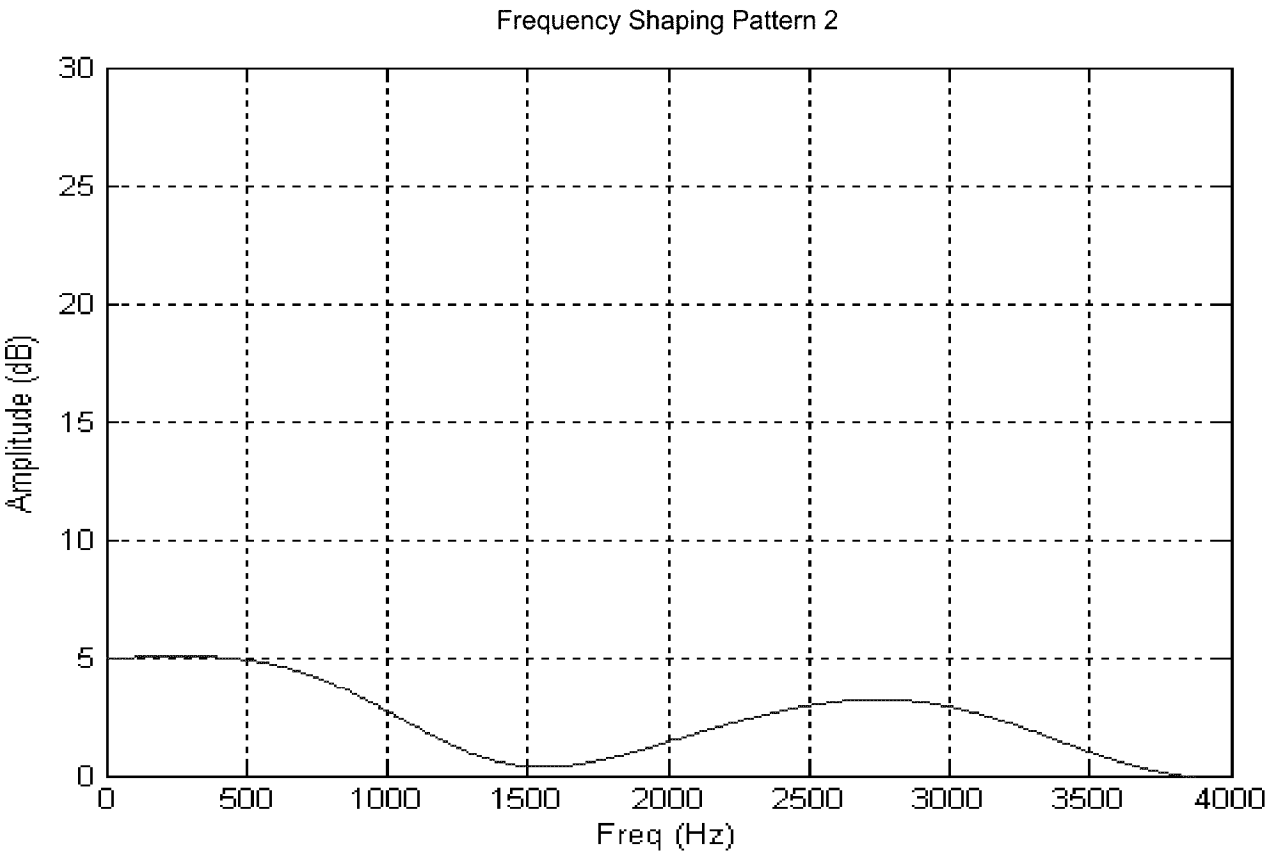
Figure 7C:
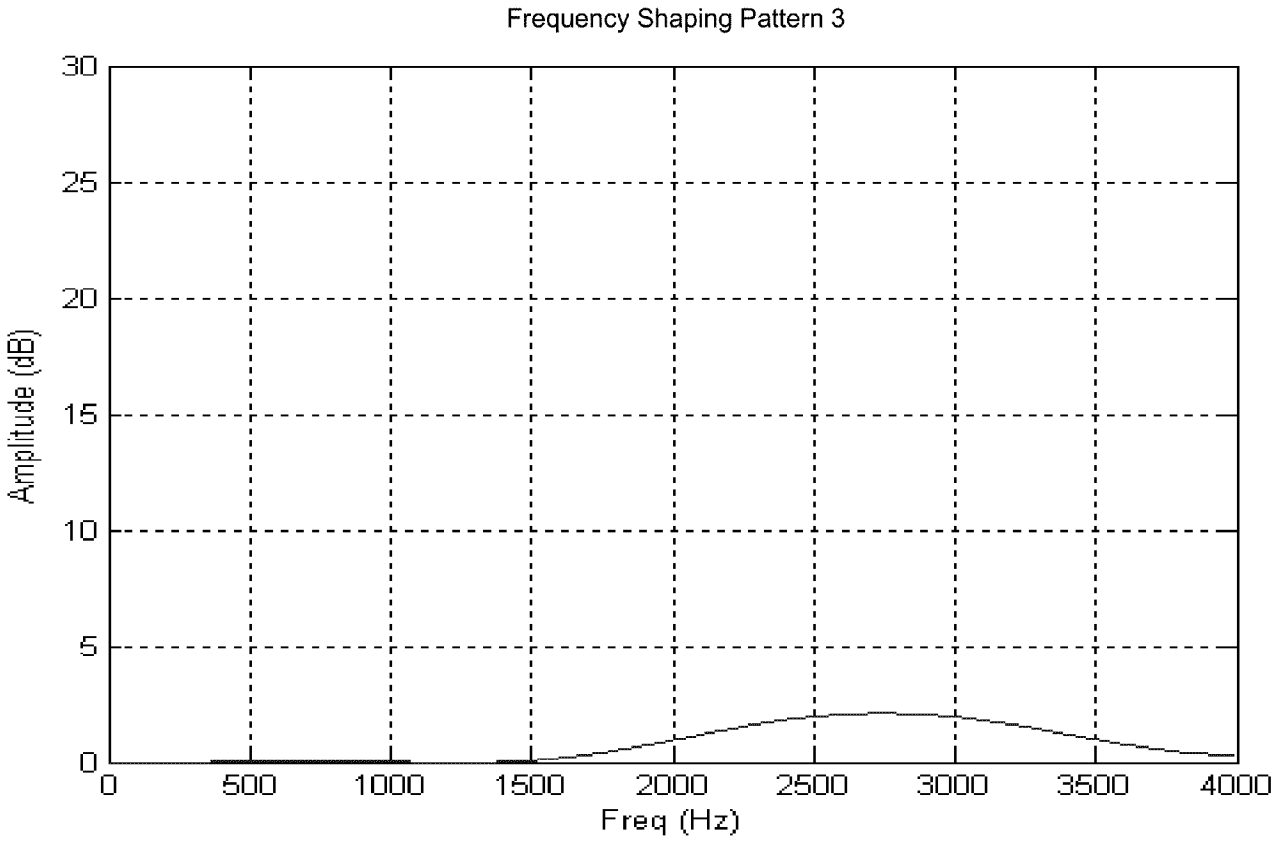
Figure 7D:
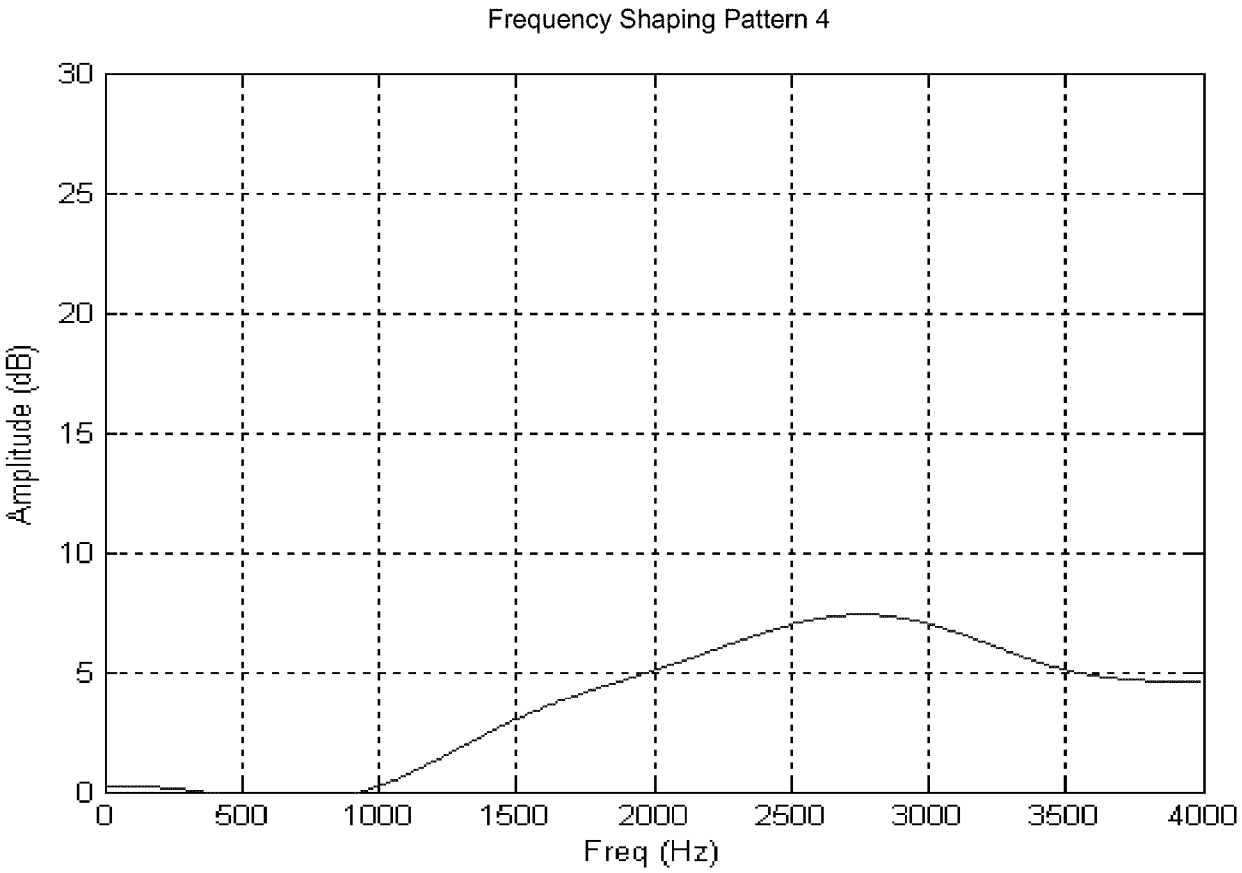
Figure 7E:
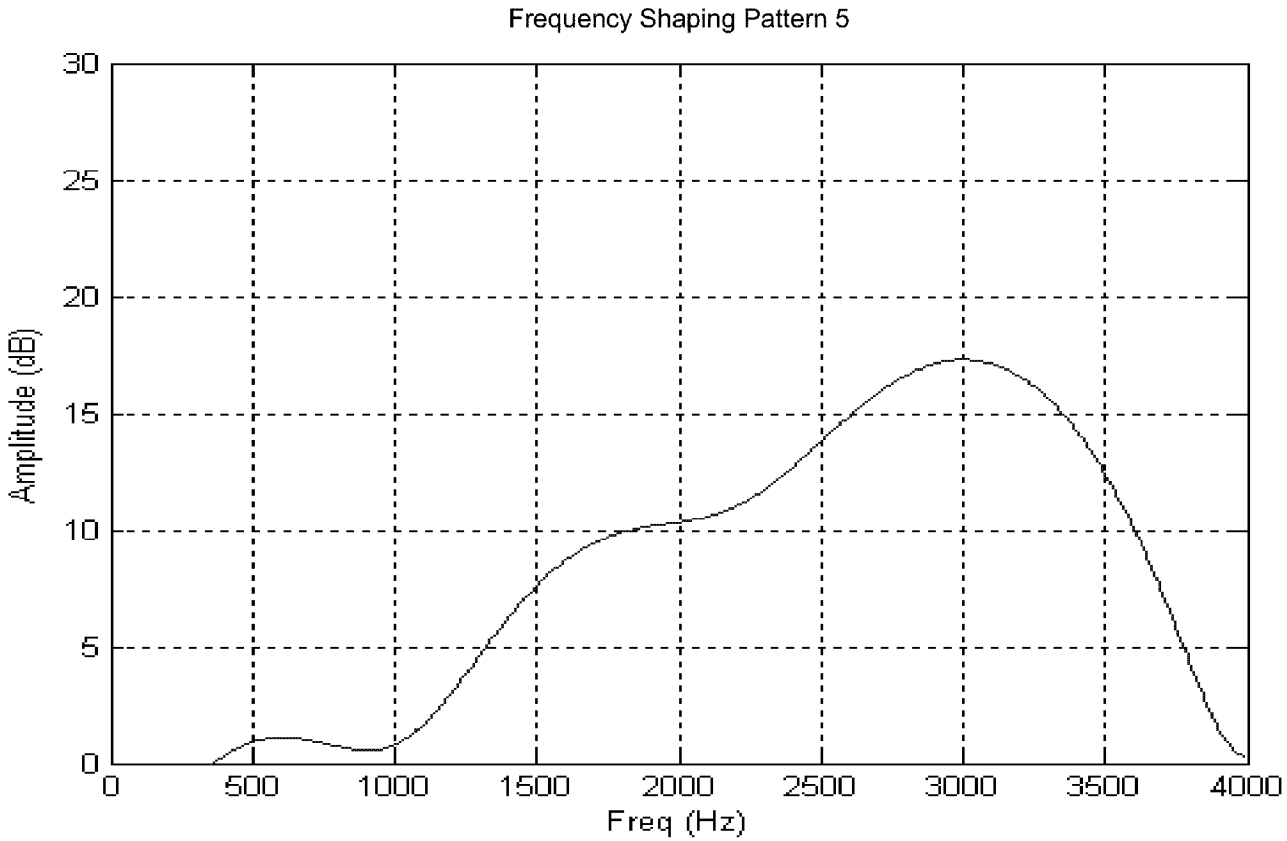
Figure 7F:
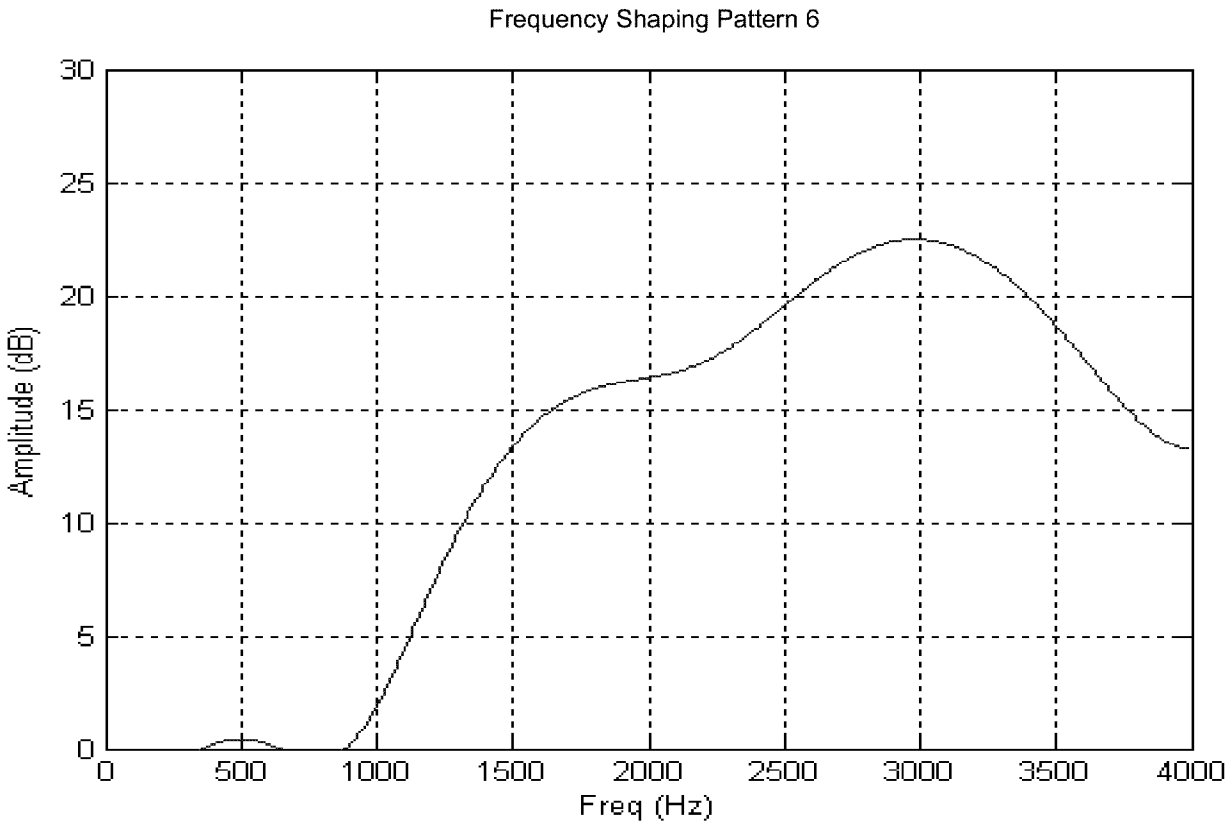

Touching hearing profile icon 912 causes the sound profile program stored in mobile phone 900 to be accessed; the sound profile program then displays the screen image 914 shown in FIG. 5. Screen image 914 includes a task bar 916 having a personal icon 918. Pressing on personal icon 918 causes the sound profile program to display the personal sound screen image 920 shown in FIG. 6. In other examples personal sound screen image 920 can be accessed in other manners, such as directly from touch screen 904 of FIG. 4. Personal sound screen image 920 has a main region 922 containing a visual indicator 924 which can be moved around main region 922 by the user touching the visual indicator and dragging it to different position on main region 922. Initial position of visual indicator 924 on personal sound screen image 920 corresponds to the current sound profile program, discussed below. Visual indicator 924 includes a central portion and crosshairs, both of which move together as the user drags the visual indicator to different positions on main region 922. Touching or tapping on personal icon 918 also causes the sound profile program to render a frame of reference on the main region 922 of the touch screen 904. Note that location indicators or indices showing coordinates on the frame of reference are not visible on touch screen 904 in this example. Positions on the frame of reference are mapped by a mapping table in software for example to corresponding locations in, for example, a table of hearing profiles located in the read-only memory 207 or read/write memory 208, or both. In one example main region 922 is divided into a 6 by 4 grid, see FIG. 10 discussed below, to create 24 different regions in the frame of reference. Each region in the frame of reference corresponds to a specific hearing profile stored in a hearing profile table within read/write memory 208. Visual indicator 924 will therefore be located in one of the 24 different hearing profile table locations in read/write memory 208. Moving visual indicator 924 therefore changes the hearing profile of the ear module 10 as discussed in more detail below. In alternative systems, the frame of reference may by provided on a user interface, other than a display surface, such as a touch pad providing two-dimensional location data in response to touch, without an associated image display. This is possible because no dynamic visual indicia of coordinate on the user interface providing the frame of reference are necessary for some implementations. In some examples that may also be possible to provide, for example, a touch sensitive user interface directly on ear module 10.

Main region 922 can also include a default position 926; positioning visual indicator 924 at default position 926 resets the hearing profile to a factory set hearing profile, commonly called the factory preset, or other hearing profile designated as a default at the time of the frame of reference is rendered. If desired other ways for selecting the default hearing profile can be used; for example task bar 916 could include a touch-selectable icon for selecting the default hearing profile. As mentioned above, the indices or other markers of coordinates on frame of reference rendered in the graphical user interface are, in this example, not visually perceptible to the user. That is, personal sound screen image 920 does not include any visual representation of what positions on main region 922 of screen image 920 are associated with specific sound profile data in this example. This permits the user to select a hearing profile by simply moving visual indicator 924 over main region 922 while listening to a sound stream broadcast by ear module 10; the sound stream being heard by the user reflects the hearing profile corresponding to the current position of the visual indicator 924 in real-time. The lack of indices, other markers of coordinates or other data correlating to location on the frame of reference, can prevent user bias in selecting hearing profiles, and for some users improve the ability to select an appropriate hearing profile.

In this example the hearing profile is generated by manipulating frequency emphasis, often called frequency shaping or frequency boosting, which is a function of gain and audio frequency, and output gain/dynamic range compression, the latter sometimes referred to as simply dynamic range compression which is a different function of gain and audio frequency. Other hearing variables and hearing profile functions, such as time constants or noise reduction aggressiveness can also be used instead of or in conjunction with these two examples.

Frequency shaping is, in this example, manipulated by emphasizing, also called boosting, the volume for selected frequency ranges so that the selected frequency ranges become louder compared with the other frequency ranges. A familiar example of frequency shaping is provided by equalizers found with many sound systems. In one example, lower frequencies are emphasized or higher frequencies are emphasized with the amount of boosting also chosen. The six different patterns of frequency shaping for this example are illustrated in FIGS. 7A-7F. Other different patterns, and numbers of patterns, of frequency shaping can also be used.

Dynamic range compression is a common technique that reduces the dynamic range of an audio signal. Dynamic range compression is usually thought of as a way of reducing the volume of very loud sounds while leaving the volume of quieter sounds unaffected. In some cases very quiet sounds are made louder while louder sounds are unaffected. Dynamic range compression is typically referred to as a ratio. A ratio of 4:1 means that if a sound is 4 dB over a threshold sound level, it will be reduced to 1 dB over the threshold sound level.

One method for enhancing an audio signal by the control of frequency shaping and output gain/dynamic range compression is discussed below with reference to FIGS. 7A-10. The basic procedure is outlined in the simplified block diagram of the signal chain in FIG. 8. The framework shown here allows the parameterization and control of frequency shaping and output gain/dynamic range compression. The gain 963 and the limiter 964 work together to produce the input/output characteristic shown in FIG. 9. The limiter 964 reduces the incoming signal amplitude by an amount based on the measured power of the signal. For a given input signal, when the gain is increased more of the signal is in the compression region of the curve, resulting in a reduced dynamic range. The compression region is that section of the curve where the change in input power is greater than the resulting change in output power. By supplying a range of gains to choose from, the dynamic range of the signal can be controlled in an efficient way. A range of gain values, such as 3 dB, 6 dB, 9 dB, and 12 dB, typically provides enough flexibility for differentiation. The limiter threshold of limiter 964 can be chosen to ensure the output transducer is not overloaded by high signal levels. Values of −3 dB to −6 dB typically work well, but this is dependent on the hardware implementation. FIG. 9 is discussed in more detail below.

The finite impulse response (FIR) filter 965 shapes the frequency characteristic of the signal. Other frequency shaping methods could be used (IIR filtering, FFT based modifications, etc.) with the same effect. One way of controlling the frequency characteristic is to provide a family of frequency shaping patterns to choose from that have a logical relationship. FIGS. 7A-7F show a possible implementation, with the six frequency shaping patterns shown in this example progressing from a response with low frequency emphasis (Pattern 1) to a response with high frequency emphasis (Pattern 6). The relationship between these frequency shaping patterns allows them to be ordered in a coherent way for the end user. Moving from Pattern 1 to Pattern 2 reduces the low frequency emphasis. Moving from Pattern 3 to Pattern 4 starts to increase the high frequencies, and so on.

Figure 8:
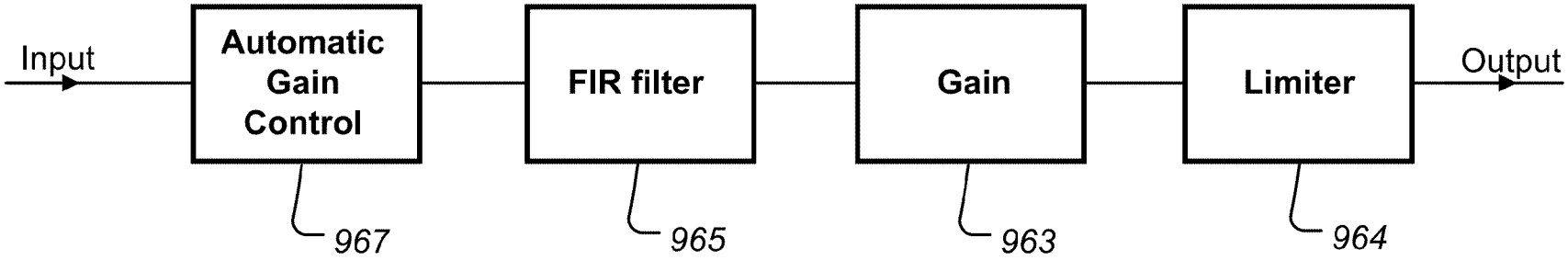
FIG. 8 is a simplified block diagram of a signal processing chain used with an example for the parameterization and control of frequency shaping and output gain/dynamic range compression.
Figure 9:
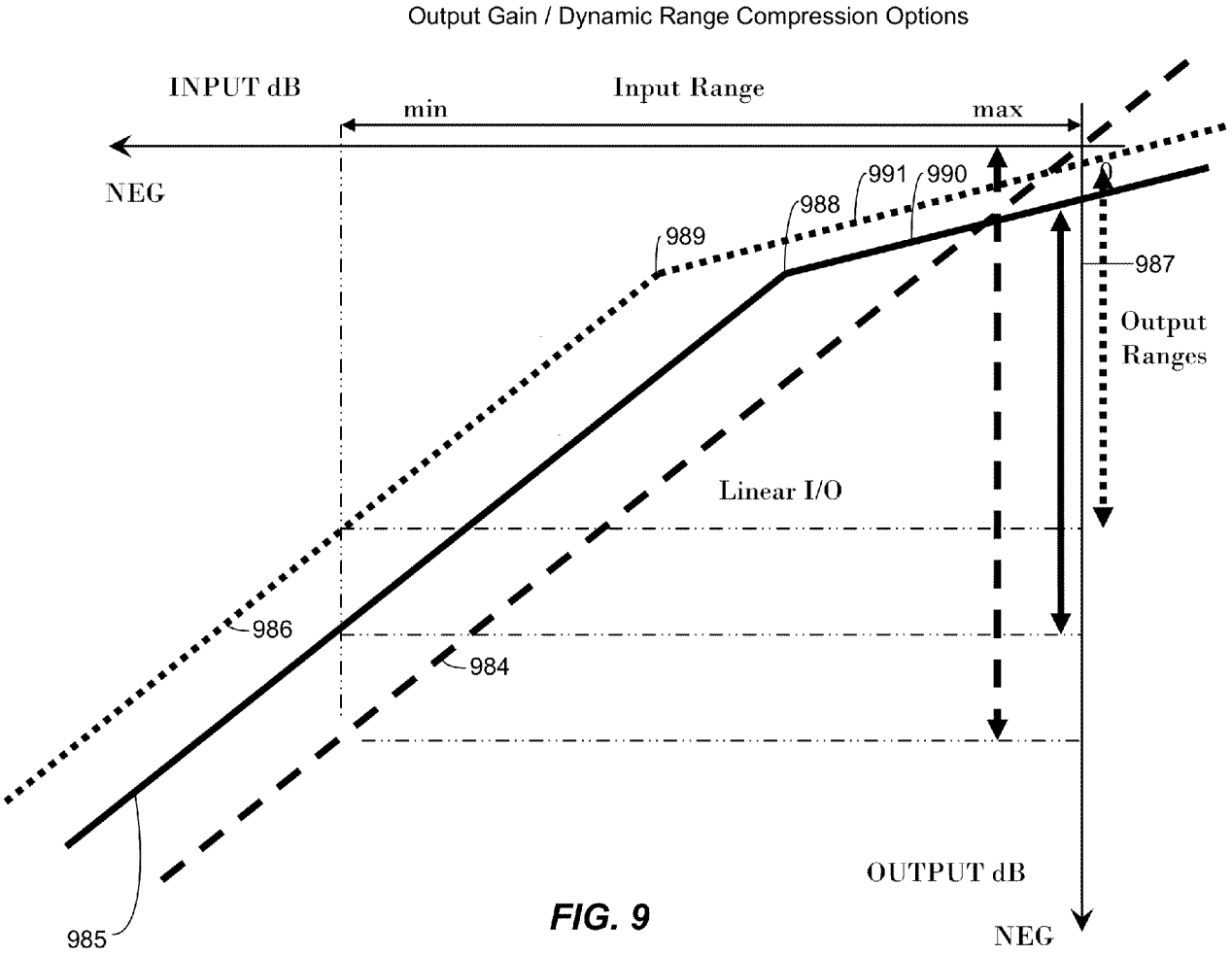
FIG. 9 illustrates how the gain and limiter boxes of FIG. 8 work to produce the input/output characteristics shown in FIG. 9.
Figure 11:
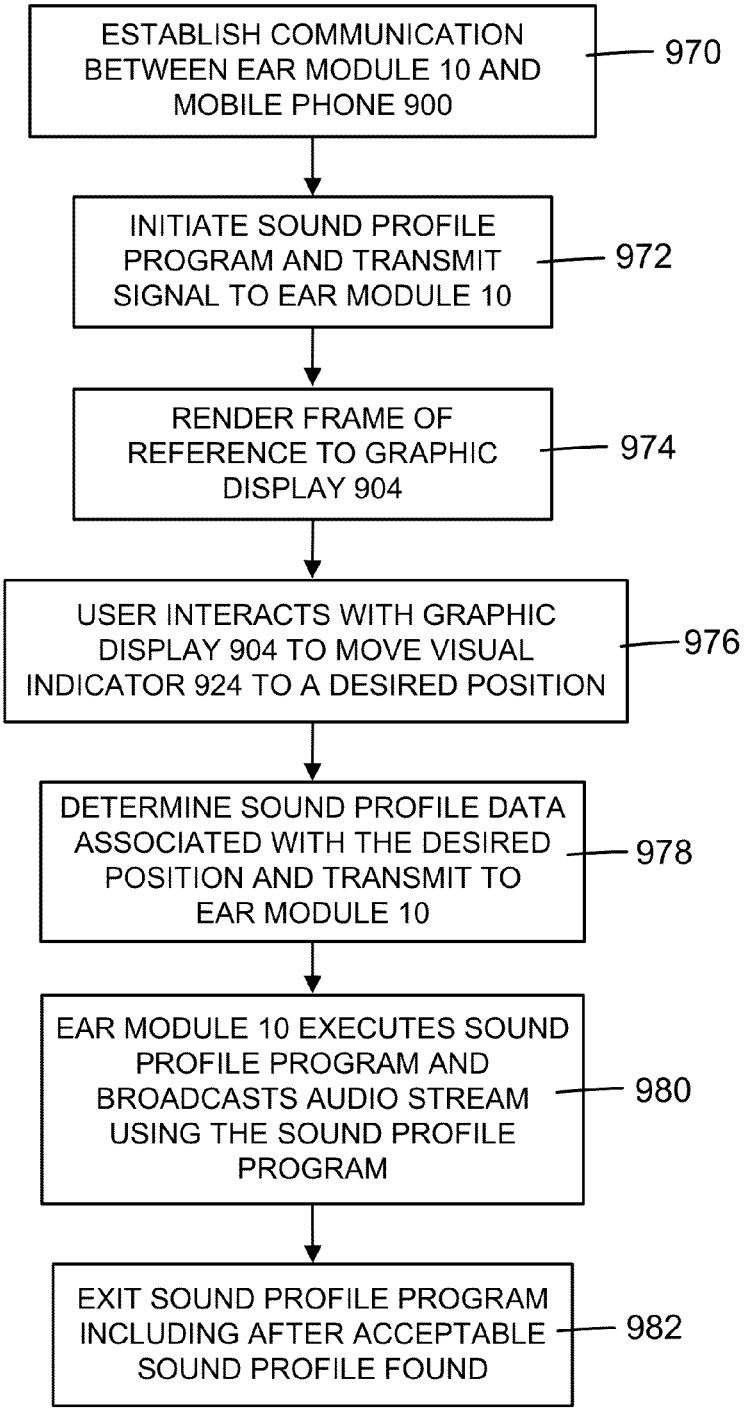
FIG. 11 is a simplified flowchart showing the basic steps of one example for generating a personalized hearing profile for an ear-level device.
Figure 12:
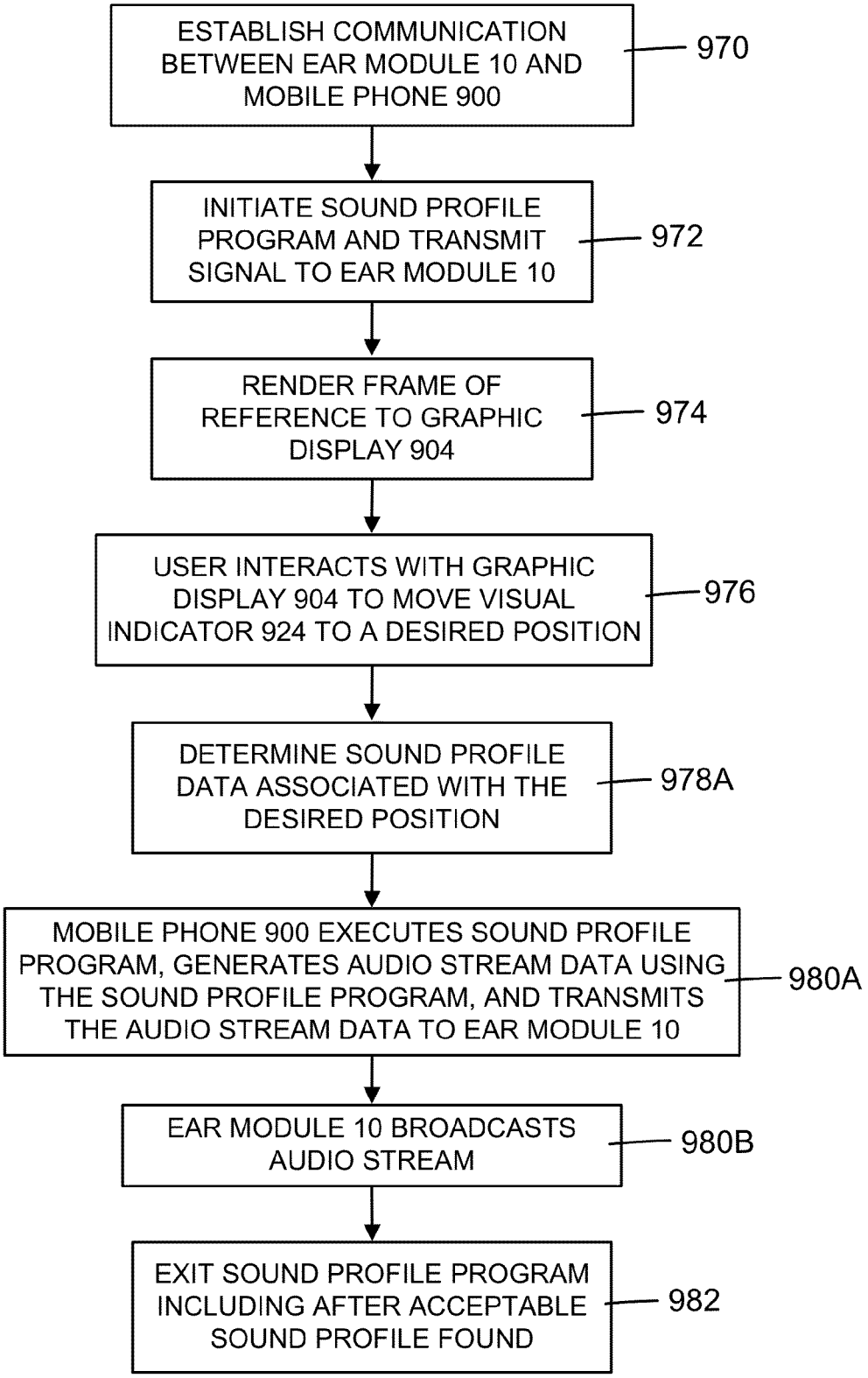
FIG. 12 is a simplified flowchart showing the basic steps of another example for generating a personalized hearing profile for an ear-level device.

The first block 967 in FIG. 8 is an Automatic Gain Control (AGC) stage that ensures input signal levels stay constant. Loud input signals are attenuated and weak signals are boosted. A received telephone signal can vary in amplitude due to different carrier networks (GSM, CDMA, etc.), different processing strategies on the near-end phone, and the original signal strength at the far-end. When processing is level dependent due to the limiter action, the signal needs to be normalized so that a given gain/limiter setting does not produce vastly different processing for a loud call and a soft call. The level is relatively constant for the entire call, so fairly slow time constants are used in the automatic gain control 967, typically around 500 ms.

FIG. 9 is a graph illustrating input/output curves corresponding to different output gain/dynamic range compression options available to the user. Input/output signal line 984 is a plot of input versus output without any gain applied to the output and without any dynamic range compression. Line 984 is, in this example, not an option for selection by the user because ear module 10 is typically used to amplify sound signals so that all of the output gain/dynamic range compression options will include an output gain in conjunction with output gain/dynamic range compression. Line 984 is illustrated for the purpose of showing how the user-selectable output gain/dynamic range compression options differ from an unmodified input/output line. Lines 985 and 986 illustrate the second and fourth output gain/dynamic range compression options available to the user. Each line shows the effect of a basic gain in output, in this example 6 dB for the second output gain/dynamic range compression option illustrated by line 985, and 12 dB for the fourth output gain/dynamic range compression option illustrated by line 986. The input/output plots representing the first and third output gain/dynamic range compression options lie between lines 984/985 and 985/986, respectively, and have basic gain of 3 dB for the first option and 9 dB for the third option. For each of the output gain/dynamic range compression options, compression begins when the output reaches a compression output threshold 987, −6 dB in this example. At this output, indicated by the inflection points 988, 989 in lines 985, 986, the slope of the compressed portions 990, 991 of lines 985, 986 corresponds to the compression ratio, 4:1 in this example. The use of dynamic range compression avoids having the output signal be too loud when the input signal is at the high end, that is on the right-hand side of the graph in FIG. 9. A function based on dynamic range compression can be constant across all frequencies in the audio spectrum supported by the device, or can be variable across frequency, or across frequency bands, in the audio spectrum.

FIG. 10 illustrates different combinations of output gain/dynamic range compression options versus frequency shaping patterns. Each of these combinations corresponds to a hearing profile stored in read/write memory 208. For example, combination number 992 combines the low frequency emphasis of frequency shaping pattern 1 of FIG. 10A with the first (low) output gain/dynamic range compression option. Combination number 993 combines the relatively high frequency emphasis of frequency shaping pattern 5 of FIG. 10E with the fourth (high) output gain/dynamic range compression option indicated by line 986 in FIG. 9. An example of a factory preset location, usable as a default profile, is combination number 994 which combines the frequency emphasis of frequency shaping pattern of FIG. 7D with the 6 dB (4:1) output gain (dynamic range compression option), indicated by line 985 in FIG. 9. The locations on the frame of reference can be associated with entries in a data structure that include respective combinations of a dynamic range compression function and a frequency shaping function. Changes in location along a row in FIG. 10 can be associated with changes in preset profiles related to dynamic range compression data and changes in location on a column can associated with changes in preset profiles related to frequency shaping data. Other arrangements of the location mapping process can be implemented based on empirical data that shows beneficial perceptions of the changes in the modified sound, by the users as they interactively navigate the frame of reference using audio feedback to select a preferred hearing profile.

The frequency shaping and the output gain/dynamic range compression components, shown in FIG. 10, correspond to hearing profiles and are provided as a two-dimensional matrix on main region 922 of personal sound screen image 920. For example, moving visual indicator 924 to position 958 in FIG. 6 corresponds to frequency shaping pattern 1 and output gain/dynamic range compression option 1, in which low-frequency sounds are boosted with the least amount of gain applied to the output signal. Position 958 corresponds to combination number 992 of FIG. 10. Position 960 corresponds to frequency shaping pattern 5 and output gain/dynamic range compression option 4 in which high frequency sounds are boosted with a large amount of gain. Position 960 corresponds to combination number 993 of FIG. 10. While main region 922 of personal sound screen image 920 could include visual indicia indicating frequency shaping and output gain/dynamic range compression, it is believed that for many situations it is better to leave main region 922 free of such indicia, with the possible exception of default position 926, to simplify the generation of a useful and desirable personalized hearing profile.

The use of an essentially featureless two-dimensional graphic display 904 will commonly limit the number of hearing profile parameters to two. However, an additional hearing variable, such as time constants or noise reduction aggressiveness, or hearing profile function, could be accommodated on a two-dimensional graphic display. For example, a third variable may be accessed on a two-dimensional touchscreen type of graphic display by lightly tapping on visual indicator 924 with the initial two taps accessing the third variable and additional taps accessing the different levels for the third variable. Instead of requiring additional taps, the different levels for the third variable could be accessed based on the length of time the user leaves his or her finger or stylus on visual indicator 924. However, providing for a third hearing variable is not presently preferred because some of the simplicity provided by simply moving one's finger or stylus or cursor over an essentially featureless two-dimensional display to select a personal hearing profile would be lost. However, if the selection of the third hearing variable would not affect the desirability of the choice of the first two hearing variables, typically frequency emphasis and output gain/dynamic range compression, then a third hearing very well could be a useful addition.

Generating a personalized hearing profile for an ear-level device, such as ear module 10, can be carried out as follows. Communication between ear module 10 and a companion device, such as mobile phone 900, is initiated. See 970 in FIG. 11. The communication is typically wireless but it can be wired. The initiation of the sound profile program, see 972, is typically carried out by the user selecting hearing profile icon 912 which opens up screen image 914. A signal indicating the initiation of the sound profile program is transmitted by the mobile phone 900 to the ear module 10. A frame of reference from the sound profile program stored in the mobile phone 900 is rendered, see 974, in the graphical user interface 902 by the sound profile program. Positions in the frame of reference associated with sound profile data in a sound profile data array are graphically illustrated in FIG. 10 but preferably are not marked by indices or other markers visible to the user.

The sound profile data typically comprises frequency shaping data and output gain/dynamic range compression data with the functions of output gain/dynamic range compression data mapped along a first coordinate axis and frequency shaping data mapped along a second coordinate axis. For example, the first and second coordinate axes can be defined by Cartesian-type coordinates, that is linear distances along straight lines, such as in FIG. 10, or defined by polar-type coordinates, that is a polar angle and a distance along a radial vector. However, indices of coordinates on the frame of reference are preferably not visible to a user. Therefore, with the exception of the visual indicator 924, the graphical user interface 902 is preferably free of visual indicia relating to the frame of reference for the sound profile data. The user moves visual indicator 924 about main region 922, typically by touch when the graphical user interface 902 includes a touch screen, to a desired position; see 976. In some cases, such as when the companion device is a computer, such as computer 13, for which the display is not a touch screen display, movement of visual indicator 924 can be carried out with, for example, use of a mouse or a touchpad apart from the screen. The position of the visual indicator 924 on the frame of reference results from user interaction with the graphical user interface 902. Sound profile data associated with the position is determined by the sound profile program. The sound profile data is transmitted to the ear module 10; see 978.

Ear module 10 simultaneously broadcasts an audio stream for hearing by the user, typically through the speaker of the ear module, during execution of the sound profile program; see 980. This permits the ear level device to generate sound through the speaker based upon the sound profile data corresponding to the current position of visual indicator 924 on main region 922 of screen image 920 to provide real-time feedback to the user. The user can continue to move visual indicator 924 to different chosen positions on main region 922; doing so changes the parameters of the sound profile used to generate sound through the speaker thereby changing the sound of the audio stream as it emanates from the speaker. Once an acceptable sound profile is found, which is typically determined by the sound emanating from the speaker, the user can stop moving visual indicator 924 and exit the sound profile program; see 982. The sound profile program will remain active until an end event, such as turning off mobile phone 900 or ear module 10 or by exiting the sound profile program in mobile phone 900. Also, the sound profile selected can be stored, and applied as a default profile or as a beginning profile in later interactions with the program.

In some examples the companion device transmits sound data to ear module 10 that has been generated using the hearing profile data. The procedure, see FIG. 12, generally follows steps 970, 972, 974, 976 of FIG. 11 with steps 978 and 980 replaced by steps 978A, 980A and 980B of FIG. 12. Hearing profile data associated with the position is determined by the sound profile program; see 978A. Mobile phone 900 executes the sound profile program based upon the hearing profile data corresponding to the current position of visual indicator 924 on main region 922 of screen image 920; see 980A. Mobile phone 900 generates audio stream data using the sound profile program and audio data, the audio data typically stored within the mobile phone. The audio data can be, for example, selected from different types of audio data, such as music, speech in a noisy environment, speech as generated by telephones, etc. The audio stream data is transmitted to the ear module 10. Ear module 10 broadcasts an audio stream generated from the audio stream data for hearing by the user, typically through the speaker of the ear module, during execution of the sound profile program; see 980B. The user can continue to move visual indicator 924 to different chosen positions on main region 922; doing so changes the parameters of the sound profile used to generate sound through the speaker thereby changing the sound of the audio stream as it emanates from the speaker. Once an acceptable sound profile is found, which is typically determined by the sound emanating from the speaker, the user can stop moving visual indicator 924 and exit the sound profile program; see 982. The sound profile program will remain active until an end event, such as turning off mobile phone 900 or ear module 10 or by exiting the sound profile program in mobile phone 900.

In some cases the audio stream is generated by the ambient environment and captured by the microphone of the ear module 10. The audio stream may also be generated by a device, such as cell phone 900 or computer 13, spaced apart from the ear module 10. Further, the audio stream may be stored in ear module 10. If desired the selected sound profile may be stored one or more of mobile phone 900 and ear module 10. In some examples sound profiles for different circumstances can be generated and stored; examples include listening to music generated by a digital music player through the ear module 10, and listening to telephone conversations using ear module 10 and mobile phone 900, and using ear module 10 in a environmental mode to listen to conversations. These stored personal sound profiles, commonly called personal sound profile presets, and then be quickly accessed by the user according to the current listening situation. The ease by which a personal sound profile can be generated for the current listening environment, as well as ease by which preset personal sound profile can be generated and stored, provides distinct incentives to do so.

While the present invention is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

Any and all patents, patent applications and printed publication referred to above are incorporated by reference for all purposes.

What is claimed is:

1. A method for generating a personalized hearing profile for an ear-level device of a type comprising a memory, a microphone and a speaker, each coupled to a processor, the method comprising:

establishing communication between the ear-level device and a companion device, the companion device comprising a user interface;

providing a menu including menu items having positions on the user interface, and mapping data which maps different menu items to different sound profile data, said menu items having corresponding positions on a frame of reference;

causing an audio sample to be played by the ear-level device using predetermined sound profile data to process the audio sample;

while the audio sample is being played, determining a change in position on the frame of reference, the change in position being indicated by user interaction with the user interface, and using the mapping data and the determined change in position, changing the sound profile data used to process the audio sample;

repeating the determining and changing steps while the audio sample is being played, until detection of an end event;

storing the changed sound profile data upon detection of the end event, for subsequent use as said predetermined sound profile data; and upon a menu item being selected, causing the ear-level device to process audio according to predetermined sound profile data.

2. The method according to claim 1, wherein the communication establishing step is carried out with a telephone-type companion device.

3. The method according to claim 1, the mapping data including sound profile data organized in a data structure including a plurality of entries stored in memory, the sound profile data including a plurality of preset profiles associated with respective positions on the same screen of the user interface.

4. The method according to claim 3, each preset profile comprising dynamic range compression data and frequency shaping data.

5. The method according to claim 1, including displaying a single visual indicator on the display resulting from the user interaction with the user interface, the visual indicator identifying to a position on the user interface.

6. The method according to claim 5, with the exception of the single visual indicator, maintaining the display free of visual indicia correlating location on the frame of reference to the sound profile data.

7. The method of claim 1, wherein said causing an audio sample to be played by the ear-level device includes:

transmitting the sound profile data or data identifying the sound profile data, to the ear-level device, and executing a sound profile program at the ear level device that modifies the audio sample using the sound profile data.

8. The method of claim 1, wherein said causing an audio sample to be played by the ear-level device includes:

executing a sound profile program at the companion device to modify the audio sample using the sound profile data, and transmitting the modified audio sample to the ear-level device.

9. The method of claim 1, wherein the frame of reference includes an array of positions, organized into a plurality of cells in the array, and wherein the mapping data maps a plurality positions in the array within a single cell to the same sound profile data.

10. The method of claim 1, wherein the mapping data maps positions in the field to sound profile data according to an orderly arrangement based on perceptions by users correlating the changes in position to changes in sound quality as the audio sample is played.

11. The method according to claim 1, wherein the sound profile data includes dynamic range compression data and frequency shaping data, and the mapping data associates changes in position on a first axis with changes in dynamic range compression data, and changes in position on a second axis with changes in frequency shaping data.

12. The method according to claim 1, wherein the positions on the user interface are represented in the mapping data by Cartesian coordinates or by polar coordinates.

13. An apparatus comprising:

a processor, a display, a user input device and a memory; and a computer program stored in the memory including instructions executable by the processor, to display a frame of reference having at least two dimensions on the display, and mapping data which maps different positions in the frame of reference to different sound profile data;

the computer program including instructions executable while audio data is played, to use data from the input device to determine a position on the frame reference, to use the mapping data to select sound profile data, and to cause the audio data being played to be processed using the selected sound profile data; and instructions executable while the audio data is played to use data from the input device to iteratively determine a current position on the frame reference, to use the mapping data and the current position to change the selected sound profile data used to process the audio data whereby the user is capable of perceiving a change in sound quality as a result of changes in position on the frame of reference.

14. The apparatus according to claim 13, wherein the instructions executable by the processor include instructions to cause the selected sound profile data to be stored upon detection of the end event.

15. The apparatus according to claim 13, wherein the instructions executable by the processor include instructions to send the selected sound profile data or data identifying the selected sound profile data to a device at which the audio data is processed.

16. The apparatus according to claim 13, wherein the user input device includes a touch screen.

17. The apparatus according to claim 13, wherein the instructions executable by the processor include instructions to display a visual indicator on the frame of reference resulting from the input data, the visual indicator corresponding to the position on the frame of reference.

18. The apparatus according to claim 17, wherein the instructions executable by the processor maintain the frame of reference free of visual indicia correlating position on the frame of reference to the sound profile data, with the exception of the visual indicator.

19. The apparatus according to claim 13, wherein the sound profile data comprises frequency band amplitude adjustment data and dynamic range adjustment data.

20. The apparatus according to claim 13, wherein:

the mapping data is organized in a data structure including a plurality of entries that include preset profiles stored in memory; and entries in the data structure are associated with corresponding positions on the frame of reference, wherein the positions in the field are mapped to sound profile data according to an orderly arrangement based on perceptions by users as they interactively move among positions on the frame of reference.

21. The apparatus according to claim 13, wherein changes in position on the frame of reference on a first axis are associated with changes in dynamic range compression data, and changes in position on a second axis are associated with changes in frequency shaping data.

22. The apparatus according to claim 13, wherein the positions on the frame of reference are represented by Cartesian coordinates or polar coordinates.

23. The apparatus according to claim 13, wherein the sound profile data includes a plurality of preset profiles, each preset profile comprising dynamic range compression data and frequency shaping data.

24. The apparatus according to claim 13, including a radio for a mobile phone network, and a radio for communication with a companion, ear level device.

25. The apparatus according to claim 13, wherein the frame of reference includes an array of positions, organized into a plurality of cells in the array, and wherein the mapping data maps a plurality positions in the array within a single cell to the same sound profile data.

* * * * *